US008739852B2

(12) United States Patent
Anderson et al.

(10) Patent No.: US 8,739,852 B2
(45) Date of Patent: Jun. 3, 2014

(54) ACCUMULATING WAND

(75) Inventors: Richard Anderson, Whitesville, KY (US); Steven R. Haarer, Whitesville, KY (US)

(73) Assignee: Hunter Douglas Inc., Pearl River, NY (US)

( * ) Notice: Subject to any disclaimer, the term of this patent is extended or adjusted under 35 U.S.C. 154(b) by 3 days.

(21) Appl. No.: 13/530,175

(22) Filed: Jun. 22, 2012

(65) Prior Publication Data

US 2013/0153159 A1 Jun. 20, 2013

Related U.S. Application Data

(60) Provisional application No. 61/504,466, filed on Jul. 5, 2011.

(51) Int. Cl.
*E06B 9/32* (2006.01)

(52) U.S. Cl.
USPC ..... 160/168.1 R; 160/173 R; 160/178.1 R

(58) Field of Classification Search
USPC ..... 160/168.1 R, 173 R, 178.2, 170, 191, 160/192; 242/375; 16/197, 401
See application file for complete search history.

(56) References Cited

U.S. PATENT DOCUMENTS

| | | | | |
|---|---|---|---|---|
| 4,271,893 | A * | 6/1981 | McCluskey | 160/178.1 R |
| 5,113,922 | A * | 5/1992 | Christensen et al. | 160/172 R |
| 5,671,793 | A * | 9/1997 | Lee | 160/168.1 R |
| 5,791,580 | A * | 8/1998 | Anderson et al. | 242/378.4 |
| 6,196,293 | B1 | 3/2001 | Lee | |
| 6,516,860 | B1 | 2/2003 | Weaver | |
| 6,536,503 | B1 | 3/2003 | Anderson et al. | |
| 6,901,988 | B2 | 6/2005 | Colson et al. | |
| 8,375,641 | B2 * | 2/2013 | Lundahl | 49/506 |
| 2013/0153159 | A1 * | 6/2013 | Anderson et al. | 160/168.1 V |

FOREIGN PATENT DOCUMENTS

WO WO 2005009875 2/2005

* cited by examiner

*Primary Examiner* — Blair M. Johnson
(74) *Attorney, Agent, or Firm* — Camoriano & Associates

(57) ABSTRACT

An accumulating wand includes a retraction mechanism which substantially conceals the drive cord.

6 Claims, 9 Drawing Sheets

ACCUMULATING WAND

This application claims priority from U.S. Provisional Application Ser. No. 61/504,466 filed Jul. 5, 2011.

BACKGROUND OF THE INVENTION

The present invention relates to an arrangement for opening and closing coverings for architectural openings such as Venetian blinds, pleated shades, cellular shades, and vertical blinds.

Typically, a transport system for a covering that extends and retracts in the vertical direction has a fixed head rail which both supports the covering and hides the mechanisms used to raise and lower or extend and retract the covering. Such a transport system is described in U.S. Pat. No. 6,536,503, Modular Transport System for Coverings for Architectural Openings, which is hereby incorporated herein by reference. In the typical horizontal covering product that moves downwardly from the top (top/down), the extension and retraction of the covering is done by lift cords or lift tapes suspended from the head rail and attached to the bottom rail (also referred to as the moving rail or bottom slat). In a Venetian blind, there are ladder tapes that support the slats, and the lift cords usually run through holes in the middle of the slats.

Raising and lowering the covering may be done by pulling directly on the lift cords or tapes or by operating a drive cord, which drives a mechanism inside a rail (usually a fixed head rail) that rotates a lift rod and lift spools to cause the lift cord or tape to wind and unwind. (It is understood that, when the phrase "lift cord" is used in this application, it also includes lift tapes.)

Some window covering products are built in the reverse (bottom-up), where the moving rail, instead of being at the bottom of the window covering bundle, is at the top of the window covering bundle, between the bundle and the head rail, such that the bundle is normally accumulated at the bottom of the window when the covering is retracted and the moving rail is at the top of the window covering, next to the head rail, when the covering is extended. There are also composite products which are able to do both, to go top-down and/or bottom-up.

Known cord drives have some drawbacks. For instance, the cords in a cord drive may be hard to reach when the cord is high up (and the blind is in the fully lowered position), or the cord may drag on the floor when the blind is in the fully raised position. The cord drive also may be difficult to use, requiring a large amount of force to be applied by the operator, or requiring complicated changes in direction in order to perform various functions such as locking or unlocking the drive cord.

It also has been found desirable to reduce or eliminate the amount of exposed cord.

SUMMARY OF THE INVENTION

The present invention provides an arrangement for moving a covering from one position to another which has advantages over prior art cord operated mechanisms, eliminating many of their problems. In one embodiment, the user grabs a wand which houses a mechanism that enables the wand to cover the drive cord (or lift cord), regardless of the position of the shade.

Note that throughout this specification the terms blind or shade may be used to signify a covering for architectural openings, and, unless otherwise stated, the term "drive cord" may also refer to a lift cord.

DESCRIPTION OF THE PREFERRED EMBODIMENTS

Figure 1:
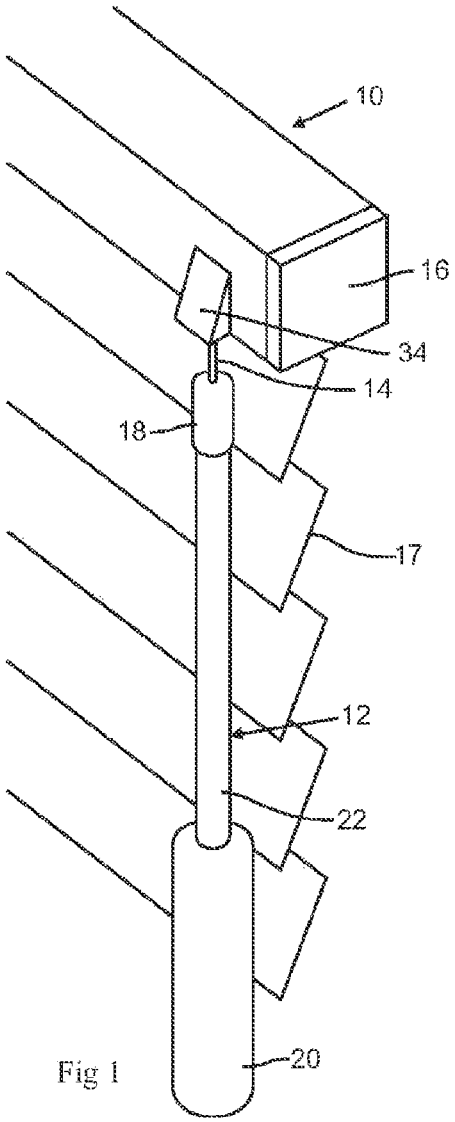
FIG. 1 is a partially broken away, schematic perspective view of a blind incorporating an accumulating wand mechanism.

FIGS. 1 through 10 illustrate one embodiment of a horizontal covering 10 for an architectural opening (which may hereinafter be referred to as a window covering or band or shade). The covering 10 shown in this particular embodiment is a band, with an accumulating wand 12 which covers any exposed drive cord 14 that is located outside of the head rail 16 (also referred to as a fixed rail 16). The drive cord 14 is functionally connected to a movable rail (not shown). An extendable covering material 17, such as the slats 17 in FIG.

1, is connected to the movable rail. The extendable covering material 17 is movable from an extended position (shown in FIG. 1) to a retracted position.

Figure 2:
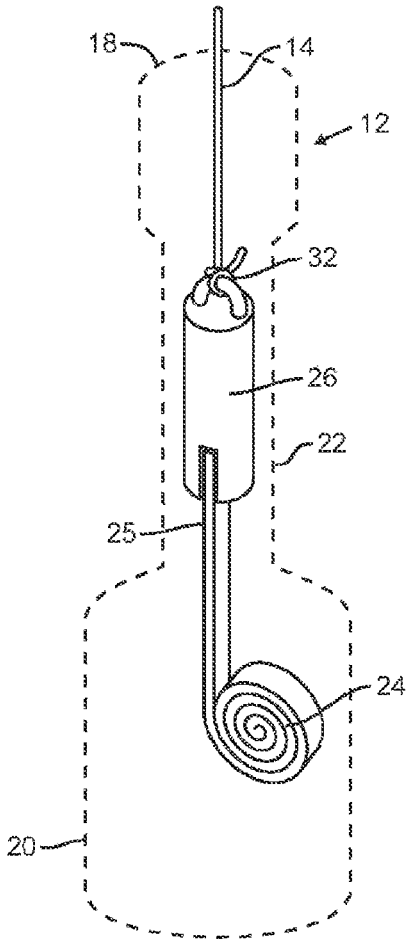
FIG. 2 is a schematic view of the internal mechanism of the accumulating wand of FIG. 1.

Referring to FIG. 2, the wand 12 defines a top, proximal end 18 and a bottom, distal end 20, which are rigidly connected together by a tubular member 22. The distal end 20 defines a larger diameter portion which houses a retracting coil spring 24. Either the free end of the coil spring 24 is too large to fit into the small diameter of the tubular member 22 or it is somehow secured to the distal end 20. In either case, the free end of the coil spring 24 is effectively trapped in the enlarged diameter, distal end 20 of the wand 12. A shuttle 26 is located inside the tubular member 22 and has a small enough diameter that it is free to travel up and down inside the tubular member 22.

A first end 32 of the drive cord (or lift cord) 14 enters the interior of the wand 12 through an opening in the proximal end 18 and is secured to the top of the shuttle 26, and one end 25 of the coil spring 24 is secured to the bottom end of the shuttle 26, as shown in FIG. 2. As may be appreciated in FIG. 1, the drive cord 14 exits the proximal end 18 of the wand 12 and enters the head rail 16 through a releasable cord lock mechanism, which may be a bail lock mechanism 34 as is well known in the industry, or which may be some other type of cord lock mechanism.

Figure 3:
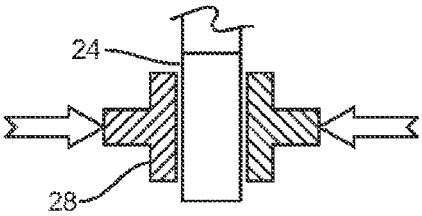
FIG. 3 is a schematic of a disk brake mechanism for the accumulating wand mechanism of FIG. 2.
Figure 4:
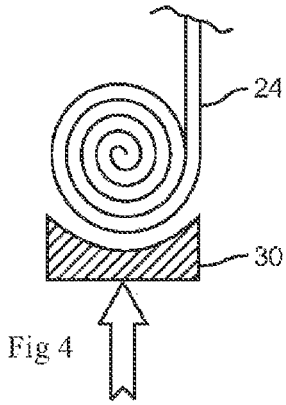
FIG. 4 is a schematic of a drum brake mechanism for the accumulating wand mechanism of FIG. 2.

Omitted from FIG. 2 is a brake, which is used to selectively prevent the retracting coil spring 24 from winding or unwinding inside the distal end 20 of the wand 12. Two alternative types of brakes 28, 30 that could be used in the device of FIG. 2 are shown in FIGS. 3 and 4. FIG. 3 shows a disk brake 28 acting on the coil spring 24. FIG. 4 shows a drum brake acting on the coil spring 24. Any known type of brake that can be selectively engaged or released by the operator, and that prevents the spring 24 from unwinding when it is engaged, could be used. In the two brake embodiments shown here, the operator presses a button (such as the button 30' of FIG. 11) on the wand 20 to engage the brake.

FIGS. 5-10 are schematic diagrams showing the wand 12 and the head rail 16 in a series of positions representing the steps that are taken for extension and retraction of the bond 10, as explained below. The components of the wand 12, including the coil spring 24, the shuttle 26, the brake 30, and the drive cord 14 are shown schematically and not necessarily to scale. The diameter of the coil spring 24 is made larger or smaller to show whether it is wound up on itself (large diameter coil spring 24) or unwound (small diameter coil spring 24). The brake 30 is disengaged when resting on the bottom of the distal end 20 of the wand 12 in FIGS. 5, 6, 8, 9, and 10 and engaged when raised up in FIG. 7 to prevent winding or unwinding of the coil spring 24.

Figure 5:
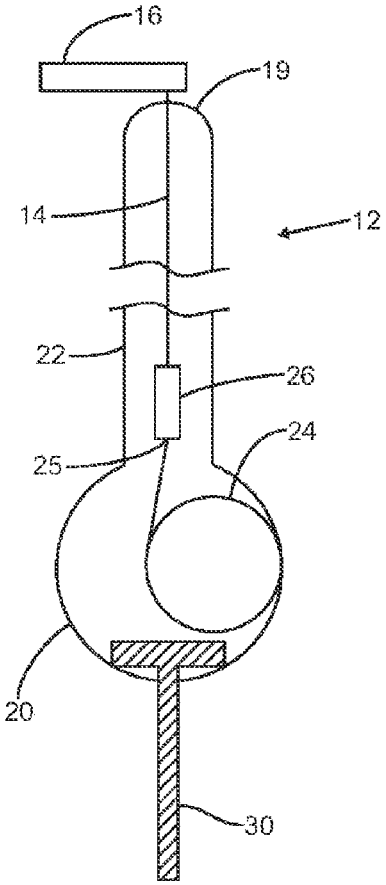
FIG. 5 is a schematic view of the accumulating wand of FIG. 2, including a brake, shown when the blind is fully raised (retracted)

FIG. 5 corresponds to when the blind 10 is at rest in the fully retracted (raised) position. At this point, the coil spring 24 is substantially wound up on itself, the brake 30 is not engaged, and the wand 12 is fully retracted, with the proximal end 18 abutting the head rail 16. Since the free end of the coil spring 24 is too large to pass into the tubular portion 22 of the wand 12 or the free end of the coil spring 24 is otherwise mounted on the distal end of the wand, it exerts a force against the wand that holds the wand 12 up against the head rail 16.

Figure 6:
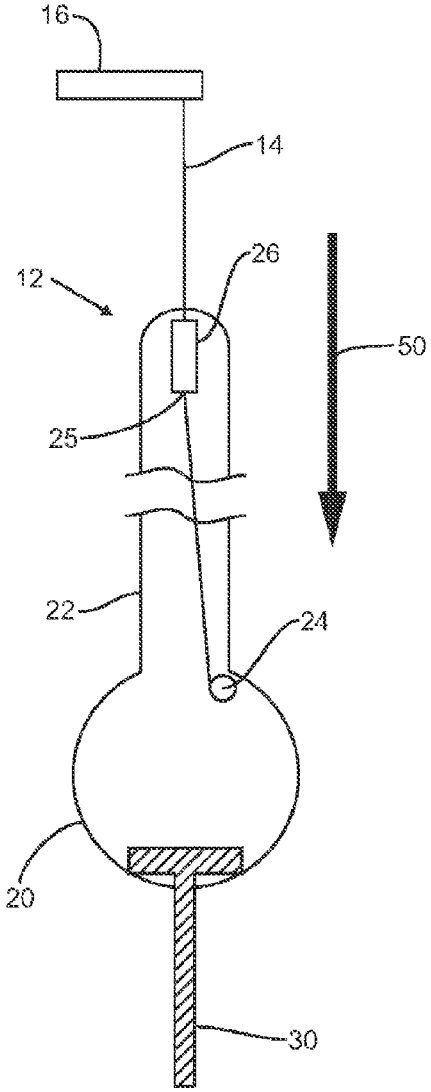
FIG. 6 is a schematic view, similar to FIG. 5, showing when the wand is pulled down by the user, in preparation for lowering (extending) the blind.

To lower (extend) the blind 10, the user pulls down on the wand 12, as shown by the arrow 50 in FIG. 6. This causes the coil spring 24 to unwind and allows the wand 12 to travel downwardly relative to the shuttle 26 until the shuttle 26 impacts against the interior of the proximal end 18 of the wand 12. As the wand 12 travels downwardly relative to the shuttle 26, the part of the drive cord 14 between the head rail 16 and the shuttle 26 is exposed, as shown in FIG. 6.

Figure 7:
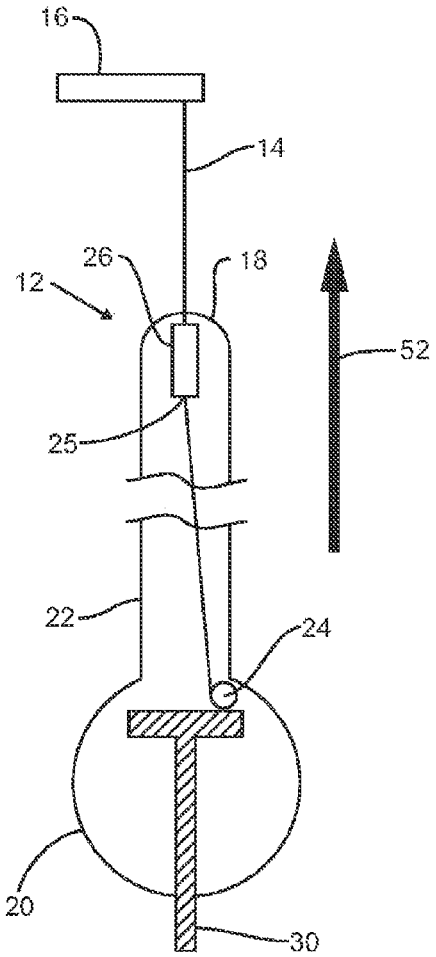
FIG. 7 is a schematic view, similar to FIG. 6, showing when the wand is led back up by the user, with the brake applied, in order to lower (extend) the blind.

The user now applies the wand brake 30 as shown in FIG. 7, unlocks the cord lock 34 and raises the wand 12 upwardly, as shown by the arrow 52. The slack in the drive cord 14 is taken up by a spool (not shown) in the headrail 16 of the blind 10, which rotates with the lift rod and lift spools as the blind 10 is lowered (extended). There may be a gear reduction or similar mechanism inside the head rail 16 that allows the covering to travel a greater distance than the distance travelled by the drive cord 14, if desired. (If the drive cord 14 is the same cord that is secured to the bottom rail of the blind 10, then the spool, lift rod, and lift spools are not used, but the operation of the wand 12 would otherwise be the same.)

Figure 8:
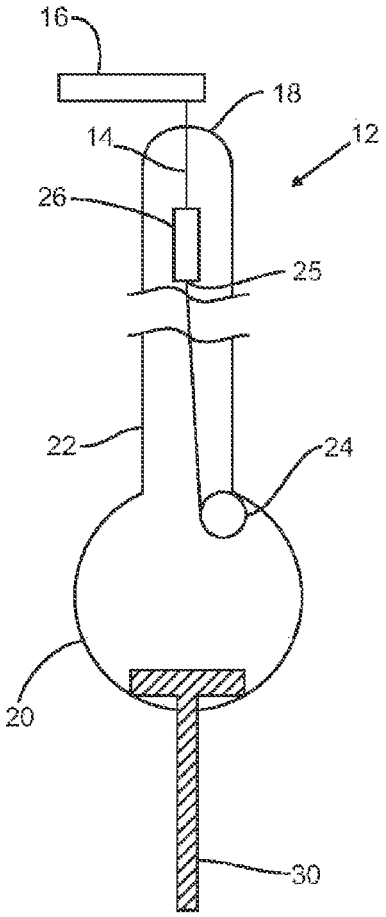
FIG. 8 is a schematic view, similar to FIG. 7, showing when the wand is released by the user once the blind is in the fully lowered (extended) position.

When the blind 10 is fully lowered, most of the drive cord 14 is taken up on the spool inside the head rail 16 (or, if the drive cord 14 is a lift cord, it is extended along with the extended blind itself). Any remaining drive cord 14 which is not fully taken up inside the head rail 16 or fully extended with the blind will be retracted into the wand 12 by the partial winding up of the coil spring 24 once the wand 12 is released, since releasing the wand 12 also releases the brake 30. This position is shown in FIG. 8.

Figure 9:
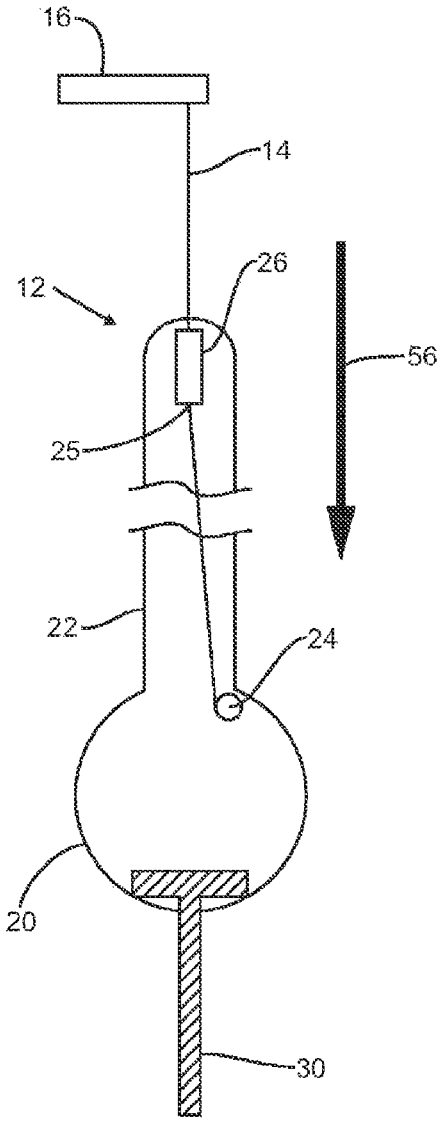
FIG. 9 is a schematic view, similar to FIG. 8, showing when the wand is pulled down by the user, in preparation for raising (retracting) the blind.

Now, to raise (retract) the shade 10, the user pulls downwardly on the wand 12 as shown by the arrow 56 in FIG. 9. At first, the coil spring 24 will unwind until the top of the shuttle 26 impacts against the proximal end 18 of the wand 12. Further pulling on the wand 12 results in pulling directly on the drive cord 14, raising the blind 10 and exposing the drive cord 14. If desired, the user may engage the wand brake 30 prior to pulling downwardly on the wand 12 in order to prevent the mostly unwound coil spring 24 from having to unwind completely before the wand begins pulling on the drive cord 14. (It should be noted that the wand brake 30 may be engaged or released at any time to facilitate raising or lowering the shade 10.)

Figure 10:
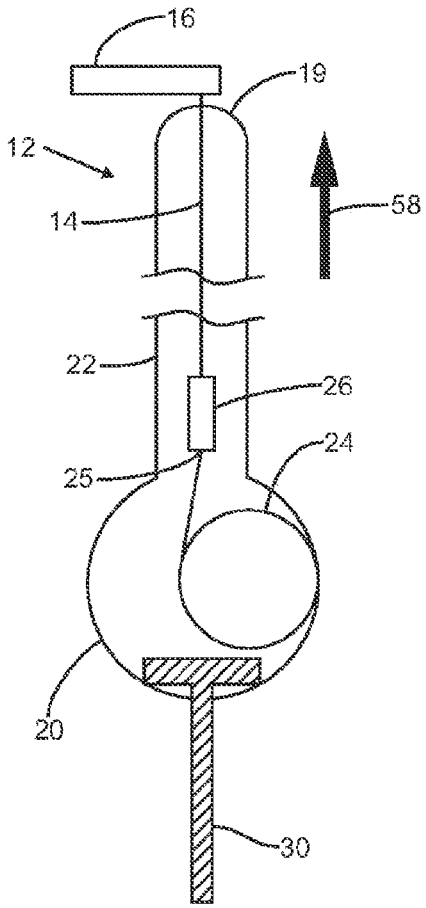
FIG. 10 is a schematic view, similar to FIG. 9, showing when the wand is led back up by the user once the blind is in its raised (retracted position)

The user then locks the cord lock 34, which prevents the cord 14 from moving relative to the head rail 16, and then releases the wand 12, which allows the coil spring 24 to wind up, retracting the drive cord 14 into the wand 12 and moving the wand 12 back up to the head rail 16 (as shown by the arrow 58 in FIG. 10). Now the coil spring 24 is substantially wound up onto itself, and the blind 10 is in the fully raised position, which returns the arrangement to the identical condition shown in FIG. 5.

The user also may raise or retract the blind 10 in short strokes instead of in one single long stroke, if desired. To raise the blind 10 in short strokes, he first pulls down on the wand 12, as shown in FIG. 9, and then engages the cord lock 34, but stops short of the full stroke. He then releases the wand 12 which retracts upwardly to the head rail 16, to cover up any exposed drive cord 14. He then applies the wand brake 30 to prevent the unwinding of the coil 24 and pulls down on the wand 12 to pull the cord 14 further out of the head rail 16 and further rotate the lift rod, which causes the lift drums inside the head rail 16 to further rotate to retract the lift cords on the blind 10. He then again engages the cord lock 34 and releases the wand, which retracts upwardly to the head rail. He may do this repeatedly until he finishes raising the blind 10, and again engages the cord lock 34. Once the blind 10 is fully raised, and the cord 14 is held in position by the cord lock 34, the user releases the wand brake 30, and the wand 12 retracts upwardly to the head rail 16 to cover the drive cord 14.

Alternate Embodiments

Figure 11:
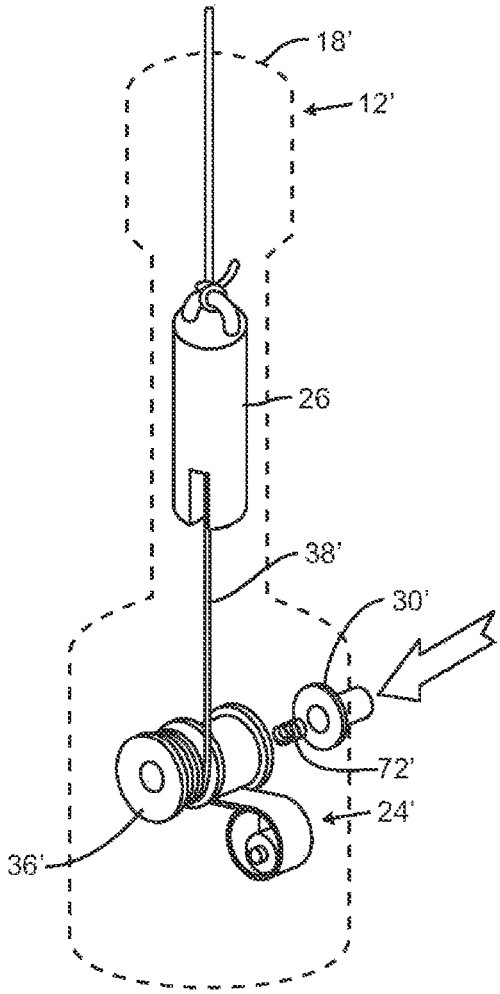
FIG. 11 is a schematic view of an alternate embodiment of the internal mechanism of the accumulating wand of FIG. 1.

FIG. 11 shows an alternate embodiment of a wand 12' which may be used in the blind 10. Comparing this wand embodiment 12' with the wand embodiment 12 of FIG. 2, it may be appreciated that the only substantial difference is the alternate spring 24', the winding and unwinding of which is used to rotate a spool 36' inside the wand 12'. An actuator cord 38' is securely attached at its first end to the bottom of the shuttle 26 and at its second end to the spool 36', so, as the spring 24' extends and the spool rotates in one direction, the spring wraps around its end of the spool 36', which causes the cord 38' to extend until the shuttle 26 abuts the distal end 18' of the wand 12', and, as the spring 24' winds back onto itself, it rotates the spool 36' back in the opposite direction, causing the cord 38' to retract and wrap onto the spool 36'. A brake 30' is used to selectively prevent rotation of the spool 36'. A spring 72' biases the brake 30' away from the spool 36' such that the spool 36' is free to rotate. The user presses the actuator 30' in the direction of the arrow and overcomes the biasing force of the spring 72' to apply the brake 30' to selectively prevent the spool 36' from rotation. Of course, as shown in FIGS. 3 and 4, the brake 30' may be applied directly to the retracting spring 24 instead of to the spool 36' to achieve the same end result which is to selectively prevent the retracting spring 24 from rotation. Except for these differences in the retraction mechanism, the wand 12' operates in substantially the same manner as the wand 12 described above.

Figure 12:
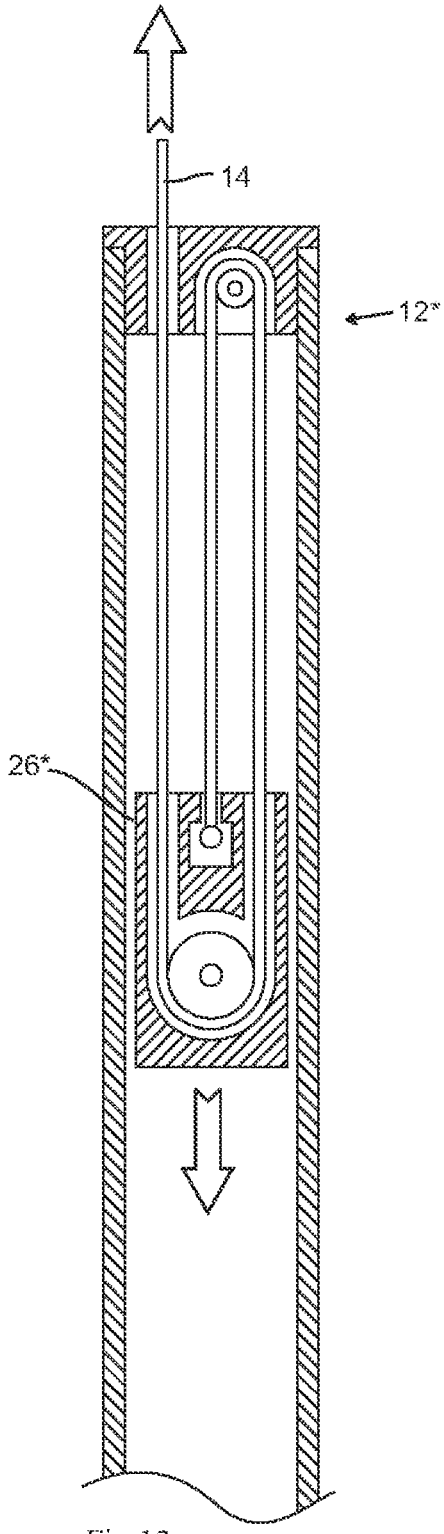
FIG. 12 is a schematic section view of an alternate embodiment of a shuttle for the accumulating wand of FIGS. 2 and 11.

FIG. 12 shows an alternate embodiment of a wand 12* and shuttle 26* which may be used instead of the wand 12 or 12' and shuttle 26 of FIGS. 2 and 11, with only minor modifications to the wand 12 or 12'. In this instance, the shuttle 26 of FIGS. 2 and 11 is replaced with a block and tackle shuttle 26*. The block and tackle shuttle 26* shown in FIG. 12 is a three line block and tackle resulting in a tripling of the length of drive cord 14 that is retracted for every length of travel of the block and tackle shuttle 26*. Of course, any desired multiplier may be used, albeit at the expense of additional force required to move the shuttle 26* as compared to an un-multiplied design, such as that in FIG. 2. This block and tackle shuttle 26* may be used with any of the retraction mechanisms disclosed herein (such as the spring 24 of FIG. 2 or the alternate spring 24' of FIG. 11), and the wand 12* operates in substantially the same manner as the wands 12 and 12' described above.

Figure 13:
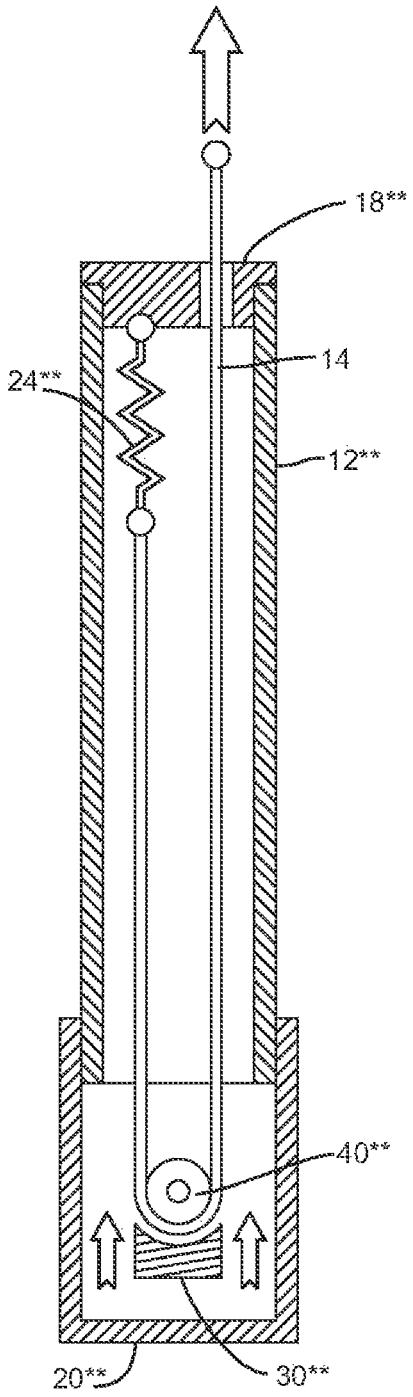
FIG. 13 is a schematic section view of an alternate embodiment of an accumulating wand for use in a blind as in FIG. 1, using a tension spring instead of the coil spring of FIG. 2.

FIG. 13 shows another alternate embodiment of a wand 12* which uses a tension spring 24 instead of the coil spring 24 of FIG. 2. The drive cord 14 enters the interior of the wand 12** at the proximal end 18', as with the earlier embodiments, but in this case the cord 14 goes around a pulley 40** at the distal end 20** of the wand 12** before being attached to a first end of the tension spring 24**. The other end of the tension spring 24** is secured to the wand 12**, in this instance at the proximal end 18** of the wand 12**. This wand 12** operates in substantially the same manner as the wand 12 described above except that the wand brake 30' acts on the cord 14 instead of acting on the spring 24****.

Figure 14:
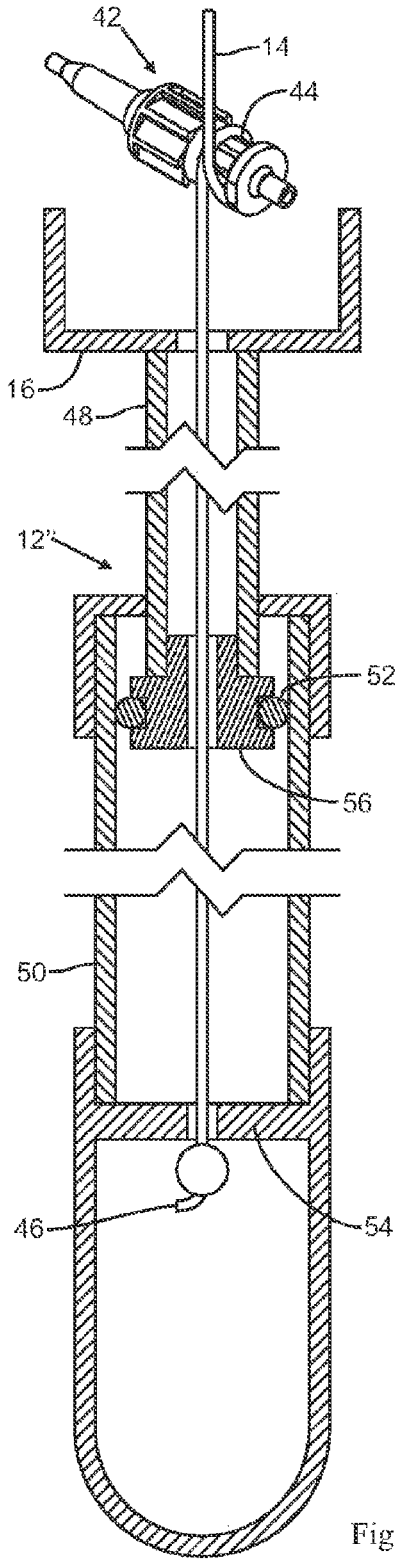
FIG. 14 is a schematic section view of yet another embodiment of an accumulating wand for use in the covering of FIG. 1, in this case it is a telescoping wand.
Figure 14A:
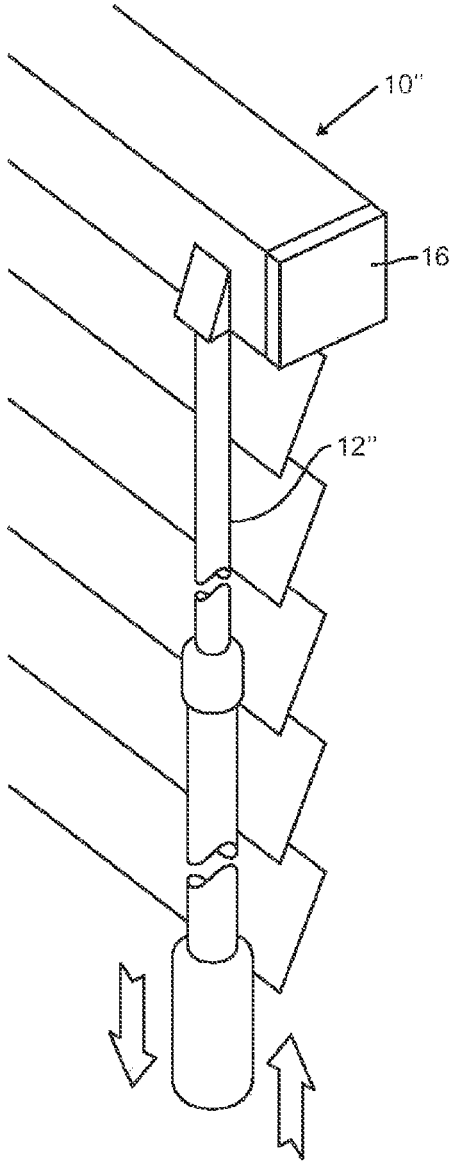
FIG. 14A shows a covering using the telescoping wand of FIG. 14.
Figure 15:
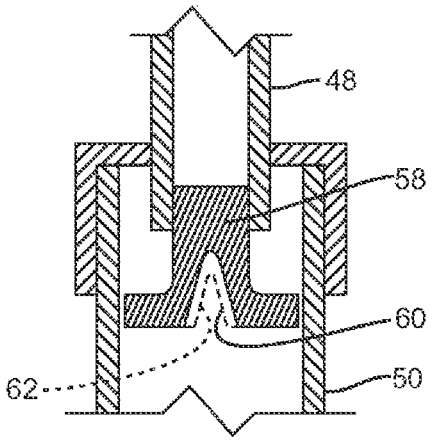
FIG. 15 is a schematic section view of an alternate friction joint which may be used in the accumulating wand of FIG. 14A.

FIGS. 14, 14A and 15 show another alternate embodiment of a wand 12". This is a telescoping, friction wand 12" as described in more detail below. This wand 12" may be used with any style cord lock, but is shown in FIG. 14 as being used with a roller lock 42 which is described in detail in Patent Application PCT/US04/22694, Drive for Coverings for Architectural Openings, filed Jul. 15, 2004, which is hereby incorporated herein by reference. Very briefly, the drive cord 14 wraps around a capstan 44 which is mounted for rotation, but which also may be displaced from a first position wherein the capstan 44 is allowed to rotate, to a second position where in the capstan 44 is prevented from rotation, with the second position being substantially immediately above the first position. In operation, when the drive cord 14 is pulled downwardly, to raise the blind 10", the drive cord 14 simply wraps and unwraps around the capstan 44 as the capstan 44 rotates about its longitudinal axis. When the drive cord 14 is released, the weight of the blind 10" pulls up on the drive cord 14, which cinches around the capstan 44, lifting the capstan 44 to its second position where it is prevented from rotation. As long as there is a weight or resistance (tension) along the "free" end 46 of the drive cord 14, the drive cord 14 remains cinched around the capstan 44. However, if this tension is relieved, the drive cord 14 is able to "surge" the capstan 44, such that the drive cord 14 is able to slip around the capstan 44 to allow the blind 10" to be lowered even though the capstan 44 may still be in its upper, locked position.

Referring to FIG. 14, the wand 12" is made in two parts 48, 50. The first part 48 is attached to the head rail 16. The second, lower part 50 of the wand 12" telescopes over the first part 48 with a "friction" joint between these two parts 48, 50. In this embodiment the "friction" joint is achieved by the use of an O-ring 52 which provides an added resistance to the telescoping action of the second part 50 over the first part 48 of the wand 12". The "free" end 46 of the drive cord 14 is secured to the second part 50 of the wand 12", preferably at or near the bottom or distal end of the second part 50.

In this embodiment of the wand 12", when the blind 10" is fully lowered (extended), the second part 50 of the wand 12" is fully (or substantially fully) collapsed over the first part 48 of the wand 12", such that the block 54 (to which the free end of the drive cord 14 is secured) is abutting the block 56 holding the O-ring 52. To raise the blind 10", the second part 50 is pulled downwardly, telescoping this second part 50 away from the first part 48 of the wand 12". This pulls down on the drive cord 14, which raises the blind 10". No drive cord 14 is exposed because the drive cord 14 is fully encased inside the two parts 48, 50 of the wand 12".

As soon as the operator stops pulling down on the second part 50 of the wand 12", the weight of the blind 10" pulls up on the capstan 44, locking the roller lock 42 against rotation. The friction from the O-ring 52 provides enough tension along the "free" end of the drive cord 14 to prevent the drive cord 14 from surging the capstan 44, so the drive cord 14 cinches around the capstan 44 and the blind 10" is locked in place.

To lower the blind 10", the user pushes up on the second part 50 of the wand 12" to collapse it over the first part 48. This action releases the tension on the drive cord 14, which allows the drive cord 14 to surge the capstan 44, and allowing the blind 10" to be lowered. The user overcomes the friction between the upper and lower parts 48, 50 caused by the O-ring 52 in order to collapse these two parts 48, 50 into each other. As the user stops pushing up on the second part 50, or when the block 54 abuts the block 56, he is no longer overcoming the friction force. This again provides the tension required to cinch the drive cord 14 onto the capstan 44, which prevents the drive cord 14 from moving, and thereby locks the blind 10" in place. Even though FIG. 14 shows only two parts 48, 50 to the wand 12", it is easy to envision the wand 12" having more than two telescoping parts or extensions.

Figure 16:
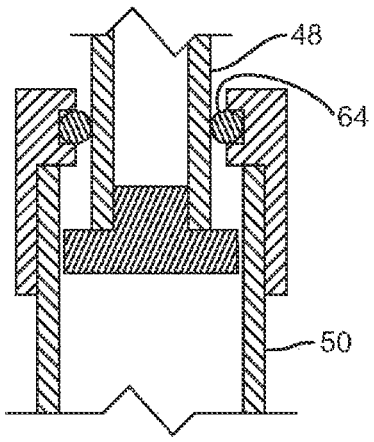
FIG. 16 is a schematic section view of yet another alternate friction joint which may be used in the accumulating wand of FIG. 14A.

FIGS. 15 and 16 show different embodiments for achieving the friction joint of FIG. 14. In FIG. 15, a flexible plug 58 (such as a rubber plug) is used instead of the block 56 with the O-ring 52 of FIG. 14. The plug 58 has a conical cavity 60 and a spring 62 in this cavity 60 expands the circumference of the plug 58 to ensure good frictional contact between the plug 58 (which is secured to the first part 48 of the wand 12") and the second part 50 of the wand 12". In FIG. 16, the friction mechanism is once again an O-ring 64. The difference between this arrangement and that shown in FIG. 14 is that in this instance the O-ring 64 is mounted in a groove on the inside surface of the outer wand portion (the second part 50 of the wand 12"), whereas in the embodiment shown in FIG. 14 the O-ring 52 is mounted in a groove on the outer surface of the block 56, which is a part of the inner wand portion 48. In both of these instances showing alternate friction joint arrangements, the wand functions in substantially the same manner as the wand 12" described with respect to FIG. 14.

Figure 17:
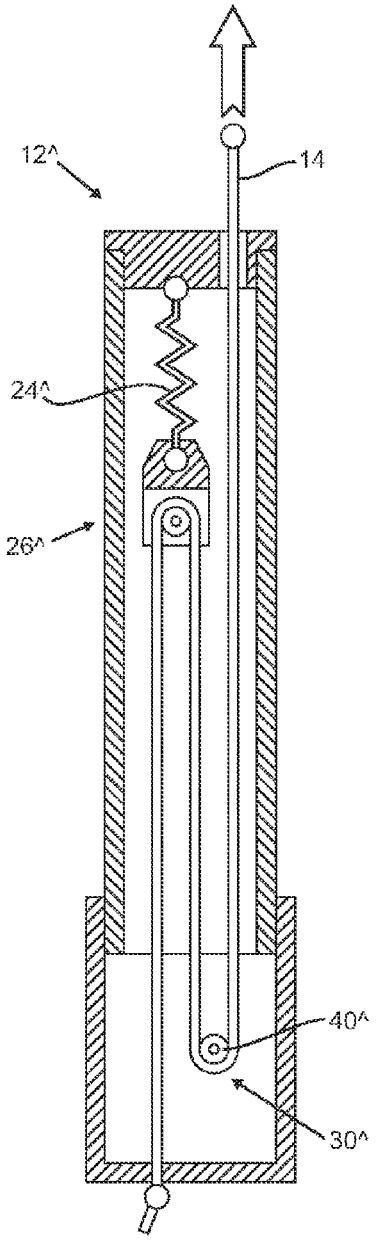
FIG. 17 is a schematic section view of an alternate embodiment of an accumulating wand for use in a blind as in FIG. 1, similar to the embodiment of FIG. 13.

FIG. 17 shows an alternate embodiment of a wand 12ˆ and shuttle 26ˆ which may be used instead of the wand 12 or 12' and shuttle 26 of FIGS. 2 and 11, with only minor modifications to the wand 12 or 12'. In this instance, the shuttle 26 of FIGS. 2 and 11 is replaced with a block and tackle shuttle 26ˆ. The block and tackle shuttle 26ˆ shown in FIG. 17 is a two line block and tackle resulting in a doubling of the length of drive cord 14 that is retracted for every length of travel of the block and tackle shuttle 26ˆ. As indicated earner, any desired multiplier may be used. This block and tackle shuttle 26ˆ is shown with a tension spring retraction mechanism 24ˆ, and a fixed axis pulley 40ˆ with a brake mechanism 30ˆ, similar to that of FIG. 13. This wand 12ˆ operates in substantially the same manner as the wand 12 described above. The brake mechanism 30ˆ may act on the pulley 40ˆ or directly on the drive cord 14**.

Figure 18:
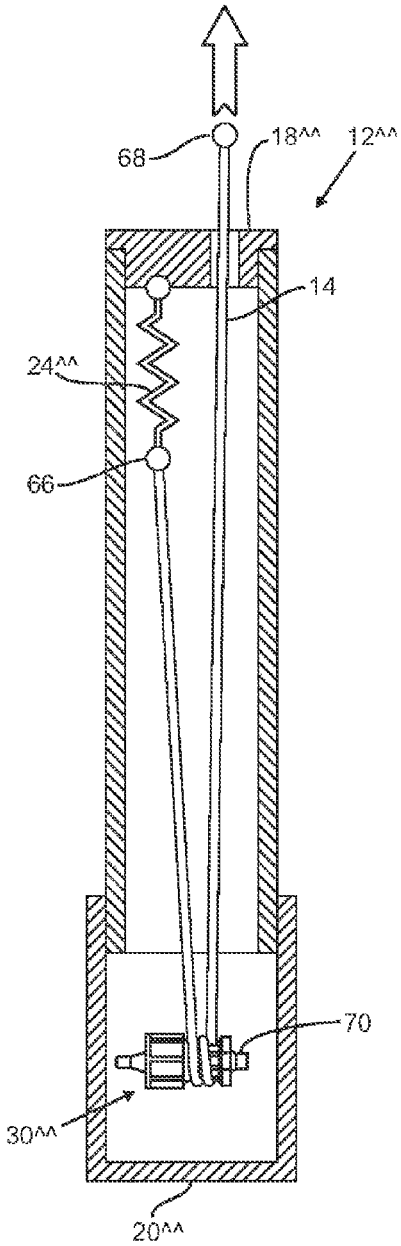
FIG. 18 is a schematic section view of an alternate embodiment of an accumulating wand for use in a blind as in FIG. 1, using a capstan for a braking mechanism.

FIG. 18 shows another alternate embodiment of a wand 12ˆˆ which uses a tension spring 24ˆˆ, similar to that of FIG. 13, and a capstan 30ˆˆ instead of the brake mechanism and pulley of FIGS. 13 and 17. The drive cord 14 enters the interior of the wand 12ˆˆ at the proximal end 18ˆˆ, as with the earner embodiments, but in this case the cord 14 wraps around a capstan 30ˆˆ at the distal end 20ˆˆ of the wand 12ˆˆ before being attached to a first end of the tension spring 24ˆˆ. The other end of the tension spring 24ˆˆ is secured to the wand 12ˆˆ, in this instance at the proximal end 18ˆˆ of the wand 12ˆˆ.

The capstan 30ˆˆ (which may also be referred to as a windlass) is a rotating machine similar to the capstan or windlass that was originally developed for use in sailing ships to apply force to ropes and cables. In a nautical application, the rode (cable or line) attached to the anchor is wound one or more times (typically several times) around the capstan (a spool-shaped cylinder that is rotated manually or by machine). One end of the rode is secured to the anchor, and the other end of the rode is tied to the boat. When the anchor needs to be raised, tension is applied to the end of the rode secured to the boat. This tightens the rode around the capstan so the rode will not slip. The capstan is then rotated, either manually or by machine, forcing the rode to wind up onto the capstan, and pulling up the anchor with it. The axis of rotation of the capstan never moves. It is common to have pawls or ratchets to lock the capstan against rotation in the opposite direction in order to easily hold the anchor where desired without having to strain to keep it there. As long as sufficient tension is kept on the end of the rode attached to the boat, the rode will not slip around the capstan, and the anchor (or other weight being hoisted) remains "locked" in that position. If the tension on the rode is relaxed, the rode slips around the capstan (referred to as "surging" the capstan), and the anchor or weight drops. Also, even if the tension is kept on the rode, if the capstan is unlocked (by the retraction of ratchets or pawls, for instance) and if the weight of the anchor pulling down on the rode is larger than the tension pulling it back, then the capstan will rotate to unwind the rode, and the anchor will fall.

In this instance, the drive cord 14 is wrapped around the capstan 30ˆˆ. The capstan 30ˆˆ has two positions; in a first position it is allowed to rotate (freewheel) about its axis, and in a second position it is locked against rotation. In the first, free-wheeling position, the drive cord 14 will rotate with the capstan 30ˆˆ even if both ends of the drive cord 14 are taut (that is, if a load is applied at both ends of the drive cord 14). In the second, locked position, the drive cord 14 cinches around the capstan 30ˆˆ and will not advance relative to the capstan 30ˆˆ if both ends of the drive cord 14 are taut. However, if one end of the drive cord 14 is not taut (that is, if the load is relieved at that end of the drive cord 14) then the drive cord 14 "surges" the capstan and the drive cord 14 may advance over the capstan 30ˆˆ.

In this embodiment, the first, free-wheeling position of the capstan 30ˆˆ is achieved by pressing a button 70, which disengages a locking mechanism to allow the free-wheeling rotation of the capstan 30ˆˆ.

Initially, when the blind is raised, the tension spring 24ˆˆ is substantially compressed and the drive cord 14 is concealed in the wand 12ˆˆ. To lower the blind, the operator unlocks the capstan 30ˆˆ (by pushing on the button 70) and then pulls down on the wand 12ˆˆ. The capstan 30ˆˆ rotates, allowing the drive cord 14 to exit the wand 12ˆˆ, revealing the drive cord 14, and stretching the tension spring 24ˆˆ. At the end of the stroke, the operator releases the wand 12ˆˆ which locks up the capstan 30ˆˆ. The weight of the blind causes the blind to lower, pulling the exposed drive cord 14 up into the head rail 16 (See FIG. 1) or into the blind itself if the drive cord 14 is the lift cord. If there is any exposed drive cord 14 (between the wand 12ˆˆ and the head rail 16) after the blind is fully lowered (or after the blind is lowered and locked in that position using a bail lock, for instance), the bad on the first end 68 of the drive cord 14 is relieved, allowing the tension spring 24ˆˆ to pull on the drive cord 14 so it will surge the capstan 30ˆˆ. The tension spring 24ˆˆ picks up the slack until the wand 12ˆˆ is pulled up against the head rail 16 and any exposed drive cord 14 is concealed in the wand 12ˆˆ.

To raise the blind, the operator releases the bail lock and pulls down on the wand 12ˆˆ while the capstan 30ˆˆ is in the locked position. Both ends 66, 68 of the drive cord 14 are thus placed in tension such that the drive cord 14 cinches around the capstan 30ˆˆ and can't surge the capstan 30ˆˆ. Pulling on the wand 12ˆˆ exposes the drive cord 14 as it is pulled out of the head rail 16, raising the blind. Once the blind is raised, the operator uses the bail lock to lock the blind, releasing the tension on the first end 68 of the drive cord 14. This allows the tension spring 24ˆˆ to pull on the drive cord 14 which surges the capstan 30ˆˆ until the wand 12ˆˆ is raised up against the head rail 6, concealing the exposed drive cord 14 into the wand 12ˆˆ.

It will be obvious to those skilled in the art that modifications may be made to the embodiments described above without departing from the scope of the present invention.

What is claimed is:

1. A window covering, comprising:

a movable rail;

an extendable covering material connected to said movable rail and defining an extended position and a retracted position;

a drive cord functionally connected to said covering material;

a hollow wand body functionally connected to said drive cord, wherein pulling on said hollow wand body moves said covering material from one of said extended and retracted positions to the other of said extended and retracted positions;

a retracting spring inside said hollow wand body which retracts the drive cord into said hollow wand body;

a brake mounted on said hollow wand body so as to selectively prevent the spring from retracting the drive cord into said hollow wand body, said brake being normally disengaged to allow said spring to retract the drive cord into said hollow wand body, and said brake including an actuator which, when engaged by the user, causes the brake to prevent the spring from retracting the drive cord into said hollow wand body.

2. A window covering as recited in claim 1, and further comprising a fixed rail and a releasable cord lock mounted on said fixed rail, said cord lock being mounted for releasably locking said drive cord relative to said fixed rail.

3. A window covering as recited in claim 2, wherein said releasable cord lock includes a capstan mounted for rotation on said fixed rail, wherein said drive cord is wrapped around said capstan and wherein pulling said hollow wand body causes said capstan to rotate and raising said hollow wand body allows said drive cord to surge said capstan.

4. A window covering as recited in claim 1, wherein, when the actuator is engaged by the user, it also causes the brake to prevent additional drive cord from being exposed outside of said hollow wand body.

5. A window covering as recited in claim 2, wherein, when the actuator is engaged by the user, it also causes the brake to prevent additional drive cord from being exposed outside of said hollow wand body.

6. A window covering as recited in claim 3, wherein, when the actuator is engaged by the user, it also causes the brake to prevent additional drive cord from being exposed outside of said hollow wand body.

* * * * *

UNITED STATES PATENT AND TRADEMARK OFFICE

CERTIFICATE OF CORRECTION

PATENT NO. : 8,739,852 B2
APPLICATION NO. : 13/530175
DATED : June 3, 2014
INVENTOR(S) : Richard Anderson and Steven R. Haarer It is certified that error appears in the above-identified patent and that said Letters Patent is hereby corrected as shown below:

In the Specification
Column 2, line 61, delete “band” and insert therefor --blind--
Column 2, line 63, delete “band” and insert therefor --blind--
Column 3, line 40, delete “bond” and insert therefor --blind--
Column 7, line 16, delete “earner” and insert therefor --earlier--
Column 7, line 29, delete “earner” and insert therefor --earlier--
Column 8, line 28, delete “bad” and insert therefor --load--
Column 8, line 45, delete “6” and insert therefor --16--

Signed and Sealed this
Thirtieth Day of September, 2014

Michelle K. Lee

Michelle K. Lee
*Deputy Director of the United States Patent and Trademark Office*